US011639659B2

(12) United States Patent
Bihun

(10) Patent No.: US 11,639,659 B2
(45) Date of Patent: May 2, 2023

(54) SYSTEM AND METHOD FOR MONITORING WELLHEAD EQUIPMENT AND DOWNHOLE ACTIVITY

(71) Applicant: QUANTUM DESIGN AND TECHNOLOGIES INC., Edmonton (CA)

(72) Inventor: Nicholas Bihun, St. Albert (CA)

(73) Assignee: Quantum Design and Technologies Inc., Alberta (CA)

( * ) Notice: Subject to any disclaimer, the term of this patent is extended or adjusted under 35 U.S.C. 154(b) by 109 days.

(21) Appl. No.: 17/261,474

(22) PCT Filed: Jan. 31, 2019

(86) PCT No.: PCT/CA2019/050122
§ 371 (c)(1),
(2) Date: Jan. 19, 2021

(87) PCT Pub. No.: WO2020/014769
PCT Pub. Date: Jan. 23, 2020

(65) Prior Publication Data

US 2021/0262342 A1 Aug. 26, 2021

Related U.S. Application Data

(60) Provisional application No. 62/699,348, filed on Jul. 17, 2018.

(51) Int. Cl.
*E21B 47/00* (2012.01)
*E21B 33/03* (2006.01)

(52) U.S. Cl.
CPC ..... *E21B 47/00* (2013.01); *E21B 33/03* (2013.01)

(58) Field of Classification Search
CPC ..... E21B 47/00; E21B 47/095; E21B 33/03
See application file for complete search history.

(56) References Cited

U.S. PATENT DOCUMENTS 4,164,149 A * 8/1979 Okubo ..... G01H 11/00 73/594
9,057,245 B2 6/2015 Wassell
(Continued)

FOREIGN PATENT DOCUMENTS

CA 2872944 11/2013
CA 2821324 1/2015
(Continued)

*Primary Examiner* — Jennifer H Gay
(74) *Attorney, Agent, or Firm* — Patrick Laycock; Rodman & Rodman LLP

(57) ABSTRACT

The internal operational state of wellhead equipment and downhole activity can be monitored with a sensor device mounted or mountable on the wellhead equipment. The sensor can include more than one vibration sensor, a sensor communications device, and a processor. The vibration sensor generates sensor signals in response to vibrations of the wellhead equipment caused by changes in the internal operating state of the wellhead equipment or downhole activity. The processor generates sensor data based on the generated electronic sensor signals. The sensor communication device transmits an electronic data signal for the sensor data via a communications network to a user device, which may be located remotely from the wellhead equipment. The user device can output a report including an audible or visible representation of the transmitted sensor data. In some embodiments, the sensor device can be retrofit to existing equipment and systems.

20 Claims, 4 Drawing Sheets

(56) References Cited

U.S. PATENT DOCUMENTS

| | | | | |
|---|---|---|---|---|
| 9,085,974 | B2 | 7/2015 | Schreiber et al. | |
| 9,598,950 | B2 * | 3/2017 | Frosell | E21B 33/12 |
| 9,611,730 | B2 | 4/2017 | Rochford et al. | |
| 10,392,927 | B2 | 8/2019 | Cherewyk | |
| 10,753,197 | B2 * | 8/2020 | Themig | E21B 47/095 |
| 2004/0245017 | A1 * | 12/2004 | Chen | E21B 44/00 175/41 |
| 2007/0140869 | A1 * | 6/2007 | St. Michel | F04B 49/22 417/63 |
| 2008/0006089 | A1 * | 1/2008 | Adnan | G01B 5/00 417/63 |
| 2014/0332199 | A1 * | 11/2014 | Gilstad | G01V 1/155 166/53 |
| 2015/0081221 | A1 * | 3/2015 | Mancini | E21B 44/005 702/9 |
| 2015/0107829 | A1 * | 4/2015 | Themig | E21B 47/095 166/250.1 |
| 2015/0240619 | A1 * | 8/2015 | Frosell | E21B 47/00 166/250.01 |
| 2015/0308253 | A1 * | 10/2015 | Clark | E21B 3/02 175/24 |
| 2016/0053593 | A1 * | 2/2016 | Romer | E21B 47/06 700/282 |
| 2016/0146001 | A1 * | 5/2016 | Chu | E21B 47/18 367/83 |
| 2017/0090457 | A1 * | 3/2017 | Pandurangan | F04C 14/00 |
| 2018/0003038 | A1 * | 1/2018 | Cherewyk | E21B 33/068 |
| 2018/0298744 | A1 * | 10/2018 | Ebrahimi | E21B 47/009 |
| 2019/0353557 | A1 * | 11/2019 | Zhang | E21B 41/00 |
| 2020/0063548 | A1 * | 2/2020 | Cai | F16K 37/0083 |
| 2020/0173272 | A1 * | 6/2020 | Themig | E21B 47/095 |
| 2020/0348223 | A1 * | 11/2020 | De Jesus | G01N 19/08 |
| 2021/0054847 | A1 * | 2/2021 | Badkoubeh | H02P 29/024 |
| 2021/0262342 | A1 * | 8/2021 | Bihun | E21B 47/00 |
| 2021/0396132 | A1 * | 12/2021 | Diiorio | E21B 47/13 |

FOREIGN PATENT DOCUMENTS

| | | |
|---|---|---|
| CA | 2977316 | 9/2018 |
| WO | 2005091899 | 10/2005 |
| WO | 2014200467 | 12/2014 |
| WO | 2015057639 | 4/2015 |

* cited by examiner

SYSTEM AND METHOD FOR MONITORING WELLHEAD EQUIPMENT AND DOWNHOLE ACTIVITY

CROSS REFERENCE TO RELATED APPLICATIONS

This application claims priority of U.S. Provisional Patent Application Ser. No. 62/699,348, entitled "System and Method for Monitoring Wellhead Equipment and Downhole Activity", filed Jul. 17, 2018, and hereby incorporated by reference herein in its entirety.

TECHNICAL FIELD

The present invention relates to diagnostic tools, systems, and methods for monitoring wellhead equipment and downhole activity.

BACKGROUND OF THE INVENTION

A variety of surface-based wellhead equipment used during oil and gas extraction operations includes internally pressurized compartments. Examples of such wellhead equipment include a ball launcher as described in Canadian Patent No. 2,821,324 (Bihun et al.), and equipment used for tool shifting operations, coiled tubing operations, packer settling operations, valve operation, perforating gun activation, and wireline operation. The operator of such wellhead equipment may wish to know the internal operational state of the equipment. In the case of a ball launcher, for example, the operator may wish to confirm that one of the balls has actually been launched downhole, before pumping fracturing fluid into the well. It will be appreciated, however, that the operator cannot directly observe the ball, and that it is practically impossible for the operator to hear the ball being launched.

Canadian Patent Application No. 2,872,944 (Themig) discloses a sensing system that includes a transducer such as a piezoelectric, piezoresistive or capacitive accelerometer, pressure transducer, or microphone, that is installed at a location capable sensing oscillations (i.e. acoustic, sonic, sound, noise, vibration, and acceleration releases) generated by actuation of a downhole tool in a well. The transducer provides acceleration data to a processing system, which processes the acceleration data to indicate a well condition such as the actuation of the downhole tool, and its movement and location. Such a system, however, can have its shortcomings. In particular, detection of background noise can prevent the collection of clean, usable data, and as such analysis and interpretation of the data can be problematic. Further, the lower end of seismic activity cannot be detected.

There remains a need in the art for an improved diagnostic device for monitoring wellhead equipment and downhole activity. Such a device is preferably economical to manufacture, physically compact, robust in construction, and allows for an operator to remotely monitor the wellhead equipment and downhole activity and diagnose potential problems, either in real time or retrospectively.

SUMMARY OF THE INVENTION

The internal operational state of wellhead equipment and downhole activity can be monitored with a sensor device mounted or mountable on the wellhead equipment. The sensor can include more than one vibration sensor, a sensor communications device, and a processor. The vibration sensor generates sensor signals in response to vibrations of the wellhead equipment caused by changes in the internal operating state of the wellhead equipment and/or downhole activity. The processor generates sensor data based on the generated electronic sensor signals. The sensor communication device transmits an electronic data signal for the sensor data via a communications network to a user device, which may be located remotely from the wellhead equipment. The user device can output a report including an audible or visible representation of the transmitted sensor data. In some embodiments, the sensor device can be retrofit to existing equipment and systems.

In one aspect, the present invention relates to a method for monitoring an internal operational state of wellhead equipment and downhole activity. The method comprises the steps of:

(a) mounting a sensor device on the wellhead equipment, the sensor device comprising at least one vibration sensor;

(b) generating an electronic sensor signal with the vibration sensor in response to a vibration of a downhole event or of the wellhead equipment caused by a change in the internal operational state of the wellhead equipment;

(c) generating a sensor datum based on the generated electronic sensor signal; and (d) transmitting an electronic data signal for the generated sensor datum via a communications network to a user device.

In embodiments of the method, the step of transmitting the electronic data signal is performed in real time relative to the step of generating the sensor datum.

In embodiments of the method, the sensor device further comprises a sensor memory, the method further comprises storing the generated sensor datum in the sensor memory, and the electronic data signal is generated based on the sensor datum stored in the sensor memory.

In embodiments of the method, the method further comprises receiving a query from the user device via the communications network, and the step of transmitting the electronic data signal is responsive to receiving the query.

In embodiments of the method, the method further comprises generating an output comprising a downhole activity report or a wellhead equipment report on a user output device of the user device, the output comprising an audible or a visible representation of the transmitted sensor data.

In another aspect, the present invention relates to a sensor device for monitoring an internal operational state of wellhead equipment and downhole activity. The sensor device is used with a user device in communication with the sensor device via a communications network. The sensor device is mounted or mountable on the wellhead equipment, and comprises:

(a) a vibration sensor for generating an electronic sensor signal in response to a vibration of a downhole event or of the wellhead equipment;

(b) a sensor communication device for transmitting electronic signals to the user device via the communications network; and (c) a processor operatively connected to the vibration sensor, the sensor communication device, and a sensor memory.

The sensor memory comprises a non-transitory computer readable medium storing a set of instructions executable by the sensor processor to implement a method comprising the steps of:

(a) generating a sensor datum based on the electronic sensor signal generated by the vibration sensor; and (b) transmitting an electronic data signal for the generated sensor datum via the communications network to the user device, using the sensor communication device.

In embodiments of the sensor device, in the method implemented by the processor, the step of transmitting the electronic data signal is performed in real time relative to the step of generating the sensor datum.

In embodiments of the sensor device, in the method implemented by the processor, the method further comprises storing the generated sensor datum in the sensor memory, and the electronic data signal is generated based on the sensor datum stored in the sensor memory.

In embodiments of the sensor device, in the method implemented by the processor, the method further comprises receiving, at the sensor device, a query from the user device via the communications network, and the step of transmitting the electronic data signal is responsive to receiving the query.

In some embodiments, the sensor device can comprise more than one sensor, wherein the more than one sensor can be configured to cross-cancel input data to reduce background noise. In some embodiments, the more than one sensor can gather data in stereo.

In some embodiments, a sensor module comprising sensor devices as described herein can be retrofit to existing equipment or sensing systems and be in communication thereto.

BRIEF DESCRIPTION OF DRAWINGS

In the drawings, like elements are assigned like reference numerals. The drawings are not necessarily to scale, with the emphasis instead placed upon the principles of the present invention. Additionally, each of the embodiments depicted is but one of a number of possible arrangements utilizing the fundamental concepts of the present invention. The drawings are briefly described as follows.

DETAILED DESCRIPTION

The present invention relates to devices, systems, and computer-implemented methods, for monitoring an internal operational state of wellhead equipment and downhole activity. These devices, systems, and methods are described by way of exemplary embodiments and uses, having regard to the accompanying drawings. The exemplary embodiments and uses are intended to be illustrative of the present invention. Accordingly, various changes and modifications can be made to the exemplary embodiments and uses without departing from the scope of the invention as defined in the claims that follow.

Any term or expression not expressly defined herein shall have its commonly accepted definition as understood by a person skilled in the art. As used herein, "wellhead equipment" may include any equipment located at the surface, at the termination of wellbore used for oil and/or gas recovery, and in embodiments, may include ball launcher, a valve assembly, or a device for actuating, controlling or otherwise interacting with a downhole tool.

Figure 1:
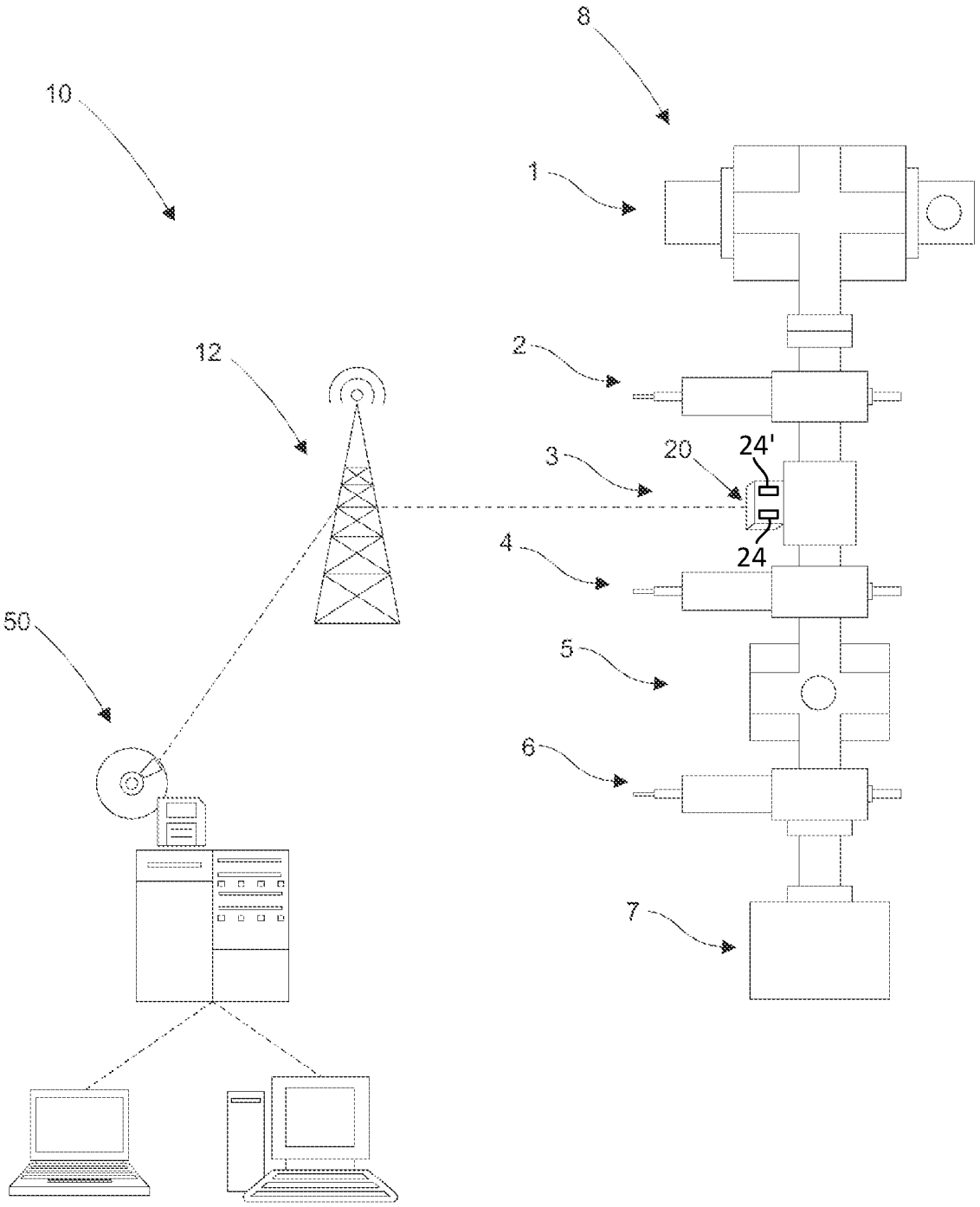
FIG. 1 shows an embodiment of the system of the present invention operatively connected to a wellhead equipment assembly comprising a ball launcher and hydraulically controlled valves.

FIG. 1 shows the exemplary use of the system (10) of the present invention for monitoring and recording the internal operational state of a wellhead equipment assembly (8) and downhole activity, for example, during hydraulic fracturing operations.

In some embodiments, the wellhead equipment assembly (8) can comprise a ball launcher (1), a first hydraulically controlled valve assembly (2), a crossover (3), a second hydraulically controlled valve assembly (4), a frac head (5) for conveying fluid from a pump truck to the wellbore, a third hydraulically controlled valve assembly (6), and a wellhead casing bowl (7). In some embodiments, the ball launcher (1) may be in accordance with the teachings of Canadian Patent 2,821,324 (Bihun et al.), the entire contents of which are herein incorporated by reference. The aforementioned components of the wellhead equipment assembly (8) may be internally pressurized during their use and operation.

In an exemplary operation of the wellhead equipment assembly (8), the operator actuates the ball launcher (1) to advance a frac ball (concealed from view) internally within the wellhead equipment assembly (8) to land on the closed first valve assembly (2). The operator then opens the first hydraulically controlled valve assembly (2) so that the frac ball advances internally through the crossover (3) to land on the closed second valve assembly (4). The operator then opens the second valve assembly (4) to advance the frac ball internally through the frac head (5), the open third valve assembly (6) and the wellhead casing bowl (7) to land on a downhole tool seat, so as to isolate a zone of the wellbore.

The operator cannot directly observe the ball as it is concealed from view, and cannot hear the landing of the ball on the valve assemblies (2, 4, 6) or the operation of the valve assemblies (2, 4, 6) internally within the wellhead equipment assembly (8) due to its robust construction and ambient noise at the wellhead. Accordingly, the operator may use the system (10) of the present invention to monitor the operation of the valve assemblies (2, 4, 6) and the movement of the frac ball within the wellhead equipment assembly (8) towards the downhole tool. This will help the operator to confirm that the frac ball is not become stuck within the wellhead assembly (8) and that the wellbore zones are properly isolated as intended before fracturing fluid is pumped at high pressure into the wellbore.

Referring to FIG. 1, the exemplary embodiment of the system (10) generally comprises a sensor device (20), and a user device (50). The sensor device (20) can be mounted on the wellsite equipment assembly (8), while the user device (50) may be located at or remote from wellhead equipment assembly (8). In some embodiments, sensor device (20) can be retrofit to mount and communicate with existing equipment and systems. The sensor device (20) and the user device (50) can be connected via a communications network (12). As used herein, "communications network" refers to any kind of network that allows for electronic signal transmission between the sensor device (20) and the user device (50), including both wired and wireless radio frequency networks. The communications network (12) may include one or a combination of cable-connected buses, a local area network (LAN), a user-server network, a wide area network including the Internet, a cellular telephone network, an infrared network, or a satellite network.

The sensor device (20) can be located externally of the wellhead equipment assembly (8) so as to avoid compromising its pressure-containing construction and to avoid exposure of the sensor device (20) to well fluids, or extreme pressures or temperatures within the wellhead equipment assembly. In an exemplary embodiment as shown in FIG. 1, the entirety of the sensor device (20) is externally mounted on the crossover (3) of the wellhead equipment assembly (8). In other exemplary embodiments, only the sensor detection module (22) (as discussed below) of the sensor device (20) may be externally mounted on the wellhead equipment assembly (8). In exemplary embodiments, the sensor device (20) may be either permanently or removably mounted on other components of the wellhead equipment assembly (8).

Figure 2:
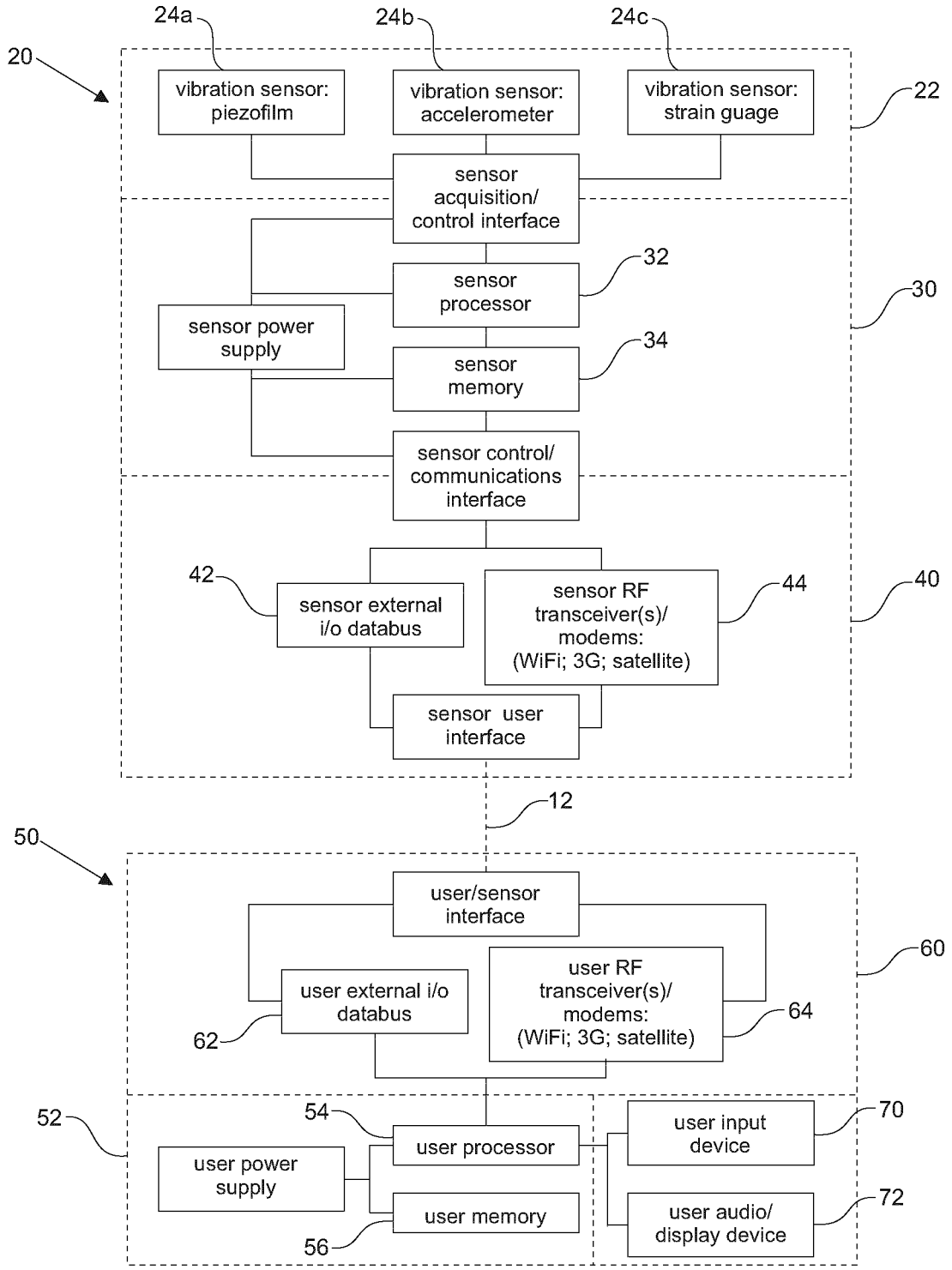
FIG. 2 shows a block diagram of an embodiment of the system of the present invention.

In FIG. 2, it will be understood the lines connecting the components represent operative connections between the components, which may be physical wired connections or wireless connections. Further, it will be understood that components shown in a single box may comprise a plurality of components, and that components shown in separate boxes may be either physically separated or physically integrated.

With reference to FIG. 2, the sensor device (20) can generally comprise a sensor detection module (22), a sensor control module (30), and a sensor communication module (40), all of which can be operatively connected to each other.

In exemplary embodiments, the sensor device (20) may comprise a case or other structure (not shown) that retains some or all of the module components of the sensor device (20). The case or other structure may be constructed to protect the module components from environmental conditions and upset conditions such as explosion of the wellhead equipment assembly (8).

A purpose of the sensor detection module (22) is to detect changes in the internal operational state of the wellhead equipment assembly (8) or downhole activity. The sensor detection module (22) comprises at least one vibration sensor (24). In some embodiments, the sensor device can comprise more than one sensor, wherein the more than one sensor can be configured to cross-cancel input data to reduce background noise. In some embodiments, the more than one sensor can gather data in stereo. In some embodiments, one sensor can be placed on top or beside another to better sense the distance away from an event or magnitude of the event being sensed. Such a configuration can allow for noise cancellation. As an example, and referring again to FIG. 1, if a first sensor (24) is closer to the downhole side of the device, and a second sensor (24') is closer to the uphole side, when an event has occurred downhole, the first sensor can sense the event before the second sensor. Accordingly, in some embodiments, if downhole signal signatures are of interest, any input received by the second sensor first can be used to block uphole input and then just display the data from the first sensor, primarily sensing downhole signatures. This system can work both ways, namely if surface signatures are of interest, it can work in the opposite fashion. In some embodiments, readings can be collected simultaneously. In the exemplary embodiment shown in FIG. 2, the sensor detection module (22) comprises three vibration sensors (24*a*, 24*b*, and 24*c*).

The vibration sensors (24) may comprise any type of device known in the art suitable for generating an electrical sensor signal in response to a vibration caused by the change in the internal operational state of the wellhead equipment assembly (8). Such changes may include movement of internal components of the wellhead equipment assembly (8). For example, in the exemplary use shown in FIG. 1, the vibration may be caused by an impact between a frac ball and one of the valve assemblies (2, 4, 6) when the frac ball lands on the valve assembly (2, 4, 6). As another example, the vibration may be caused by the movement of a moving valve member of one of the valve assemblies (2, 4, 6) or the acceleration of fluid in the wellhead equipment assembly (8). Further, detectable vibrations may be caused by a downhole event or downhole activity. Some examples of downhole events are fractures due to fracking, burst discs rupturing, packers setting, and casing breaching. In some embodiments, the detectable vibrations caused by a downhole event or downhole activity can be seismic activity due to fracking. Accordingly, the environment can be monitored and seismic events, while fracking, can be predicted before they happen.

In exemplary embodiments, the vibration sensor (24) may comprise a piezoelectric sensor that generates an electric charge when deformed by the vibration. In other exemplary embodiments, the vibration sensor (24) may comprise an accelerometer (e.g., a piezoelectric, piezoresistive, capacitive, microelectromechanical systems (MEMS)-based accelerometer). In other exemplary embodiments, the vibration sensor (24) may comprise a strain gauge that varies in electrical resistance as the strain gauge is deformed by the vibration. In embodiments of the senor detection module (22) having more than one vibration sensor (24), the vibration sensors (24) may be of the same type or different types.

In some embodiments, devices and systems can also comprise multiple sensors being used reading different parameters. Further to vibration and pressure sensors, flow, temperature, and density measurement sensors can be used to collect additional data from the well or surrounding area. In some embodiments, fiber optics can be used to provide multiple simultaneous measurements. Measurements can then be analyzed and interpreted by a processor to provide an output to be reported to the user.

A purpose of the sensor control module (30) is to receive electrical sensor signals from the vibration sensors (24), to process such electrical sensor signals to generate electronic sensor data that is indicative of the operational state of the wellhead equipment assembly (8), and to control the operation of the sensor communication module (40) to transmit electronic data signals. The sensor control module (30) can comprise a sensor processor (32) and a sensor memory (34). The sensor processor (32) can be a computer processor. In exemplary embodiments, the sensor processor (32) may comprise a microprocessor (i.e., a computer processor on an integrated circuit device). More particularly, in embodiments, the sensor processor (32) may comprise a field-programmable gate array (FPGA) that is programmable by the operator such as by commands entered via the user device (50). The sensor memory (34) is a computer storage device comprising a non-transitory computer readable medium that stores instructions that are executable by the sensor processor (32) to implement the method of the present invention, and in embodiments to store the sensor data. In exemplary embodiments, the sensor memory (34) may comprise volatile memory (i.e., memory that requires power to maintain the stored data) as well as non-volatile memory (i.e., memory that can be retrieved after power to the sensor memory (34) has been cycled on and off). In exemplary embodiments, the sensor memory (34) may comprise solid-state flash memory. The implementation of the sensor control module (30) by a microprocessor and a flash memory may allow the physical size of the sensor control module (30) to be kept small relative to the wellhead equipment assembly (8). It will be appreciated, however, that the sensor control module (30) may be implemented by a general purpose computer with appropriate software or firmware stored on a variety of non-transitory computer readable media (e.g., magnetic media, and optical media), as known to persons skilled in the art.

A purpose of the sensor communication module (40) is to transmit electronic data signals to the user device (50) via the communications network (12). In embodiments, another purpose of the sensor communication module (40) is to receive electronic signals from the user device (50) via the communications network (12). The sensor communication module (40) may comprise any type of communication device known in the art for transmitting and receiving electronic signals. In the exemplary embodiment shown in FIG. 1, the sensor communication module (40) comprises a sensor external input/out databus (42) for use with a wired communications network (12), as well as sensor radio frequency (RF) signal transceivers and modems (44), which are capable of transmitting and receiving RF signals in accordance with a variety of standards and protocols (e.g., 3G, 4G, LTE, WiFi, satellite, Bluetooth) for use with a wireless communications network (12), as known to persons skilled in the art. It will be appreciated that persons skilled in the art will be able to select appropriate sensor communication devices (42, 44) for the sensor communication module (40) having regard to considerations such as the nature of the user device (50), the nature of the communications network (12), and the physical distance between the sensor device (20) and the user device (50).

With reference to FIG. 2, the user device (50) can generally comprise a user control module (52), a user communication module (60), a user input device (70), and a user output device (72), all of which can be operatively connected to each other. In exemplary embodiments, the user device (50) may comprise a computer system or a plurality of interconnected computer systems, including without limitation, a personal desktop computer, or a mobile computer such as a laptop computer, a tablet computer, a smart phone or personal digital assistant (PDA).

A purpose of the user control module (52) is to control the operation of the user communication module (60), the user input device (70) and the user output device (72). The user control module (52) comprises a user processor (54) and a user memory (56). The user processor (54) is a computer processor. In exemplary embodiments, the user processor (54) may comprise a microprocessor (i.e., a computer processor on an integrated circuit device). The user memory (56) is a computer storage device comprising a non-transitory tangible computer readable medium that stores instructions that are executable by the user processor (54) to implement the method of the present invention, and in embodiments to store sensor data. In exemplary embodiments, the user memory (56) may comprise volatile memory (i.e., memory that requires power to maintain the stored data) as well as non-volatile memory (i.e., memory that can be retrieved after power to the user memory (56) has been cycled on and off). In exemplary embodiments, the user memory (56) may comprise solid-state flash memory. It will be appreciated, however, that the user control module (52) may be implemented by a general purpose computer with appropriate software or firmware stored on a variety of non-transitory computer readable media (e.g., magnetic media, and optical media), as known to persons skilled in the art.

A purpose of the user communication module (60) can be to transmit and receive electronic signals to and from the sensor device (20) via the communications network (12). The user communication module (60) may comprise any type of device known in the art for transmitting and receiving electronic signals. In the exemplary embodiment shown in FIG. 1, the user communication module (60) comprises a user external input/out databus (62) for use with a wired communications network (12), as well as user radio frequency (RF) signal transceivers and modems (64), which are capable of transmitting and receiving RF signals in accordance with a variety of standards and protocols (e.g., 3G, 4G, LTE, WiFi, satellite, Bluetooth) for use with a wireless communications network (12), as known to persons skilled in the art. It will be appreciated that persons skilled in the art will be able to select appropriate user communication devices (62, 65) for the user communication module (60) having regard to considerations such as the nature of the sensor device (20), the nature of the communications network (12), and the physical distance between the sensor device (20) and the user device (50).

A purpose of the user input device (70) can be to allow an operator to provide input to the user control module (52). In exemplary embodiments, the user device (50) may comprise one or a combination of various computer input devices such as a keyboard, a pointing device such as a mouse or trackball, and tactile sensors.

A purpose of the user output device (72) can be to provide a representation of the sensor data in a form that is audible and visible to a human operator. In exemplary embodiments, the user output device (72) may comprise one or a combination of a video display screen a speaker system.

Figure 3:
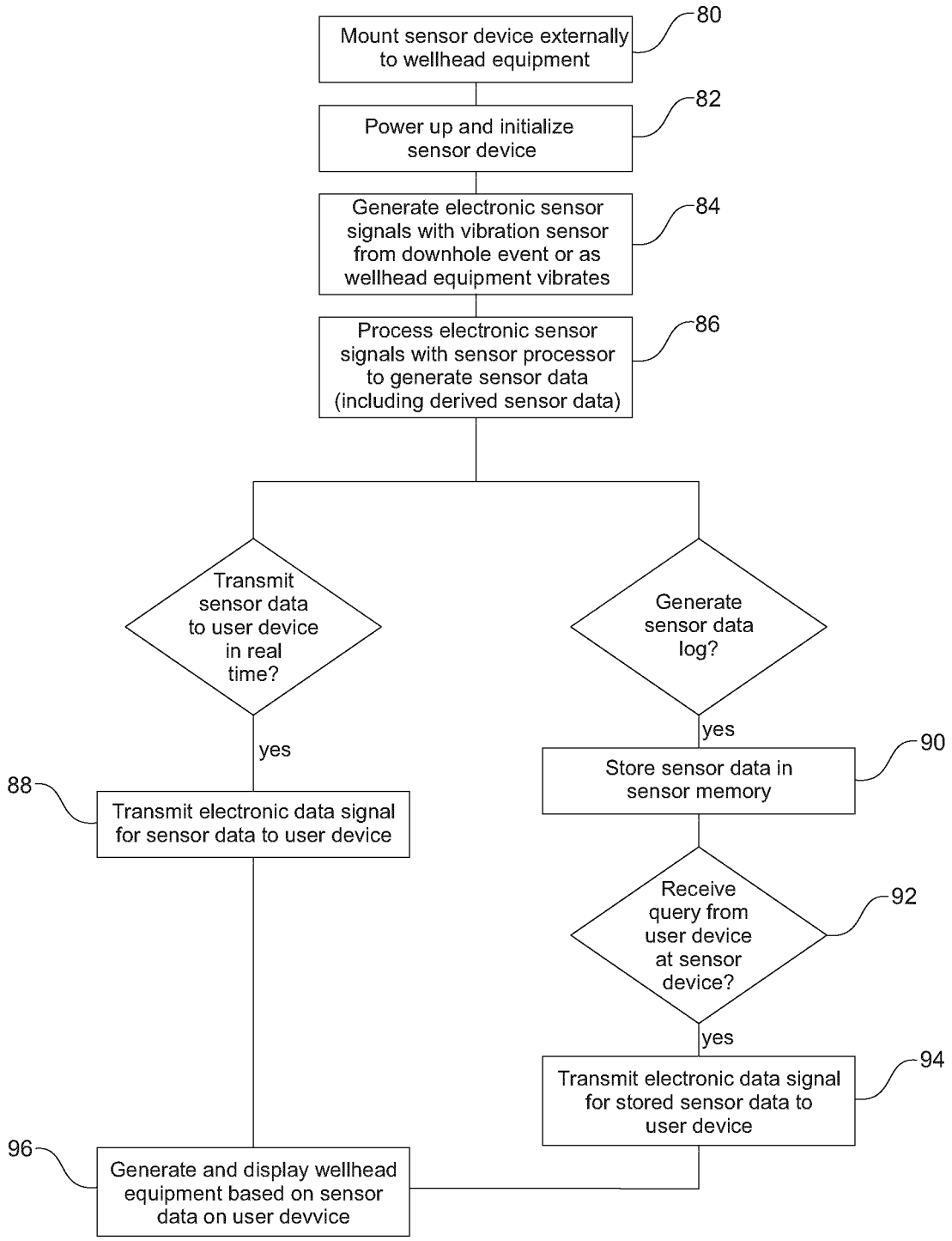
FIG. 3 shows a flow chart depicting an implementation of an embodiment of a system of the present invention, in accordance with an embodiment of a method of the present invention.

FIG. 3 shows a flow chart depicting an implementation of an embodiment of a system of the present invention, in accordance with an embodiment of a method of the present invention. The sensor device (20), or at least the sensor detection module (22) thereof, is externally mounted to the wellhead equipment assembly (8) (step 80). The sensor device (20) is powered up and the sensor detection module (22) can be initialized in a standby detection mode (step 82). As the wellhead equipment assembly (8) is put into use and operation, its various component parts may generate vibrations. The sensor detection module (22) monitors for such vibrations, and in response thereto, generates electrical sensor signals (step 84). The sensor processor (32) can receive the generated electrical sensor signals and processes them to generate sensor data that is indicative of the operational state of the wellhead equipment assembly (8) (step 86). In some embodiments, the sensor processor (32) may be programmed to sample the generated electrical sensor signals at a sampling rate having sufficient time resolution to capture vibrations of interest. The processing of the electrical sensor signals to generate sensor data may comprise converting the generated raw electrical signals to quantitative data or qualitative data. The art of generating sensor data based on electronic signals, and vice versa, is known to those skilled in the art of signal processing. In exemplary embodiments, the sensor processor (32) may perform mathematical computations based on the sensor data or compare the sensor data to a rules database to selectively filter sensor data, in order to generate derived sensor data. (As used hereinafter, "sensor data" can include derived sensor data.)

In embodiments, the sensor device (20) may use the sensor communication module (40) to transmit the generated sensor data in real time, via the communications network to a user device (50) (step 88). As used herein in this context, "real time" means that the generated sensor data is transmitted a time period that is within about 1 second, 10 seconds, 30 second, 1 minute, 2 minutes, 5 minutes, or 10 minutes, from the time that the sensor data was generated. Sensor data can be transmitted continuously or episodically in real time. In such embodiments, the user device (50) may use the user communication module (60) to receive the transmitted sensor data, and may store the transmitted sensor data in the user memory (56). Such embodiments of the method may be useful for monitoring the operation of the wellhead equipment assembly in real time. Analysis and/or interpretation of the sensor data can be performed by the system or computer in the computer-implemented method, in less time than required to perform by hand.

In embodiments, in addition to or in the alternative to transmitting the generated sensor data in real time, the sensor device (20) may use the sensor control module (30) to store the generated sensor data in the sensor memory (34) so as to generate a sensor data log (step 90). The user device (50) may then send a query to the sensor device (20) via the communications network (12) (step 92), to prompt the sensor device (20) to transmit the stored sensor data to the user device (50) (step 94). Such embodiments of the method may be useful for retrospectively diagnosing any problems associated with the operation of the wellbore equipment assembly (8).

Figure 4:
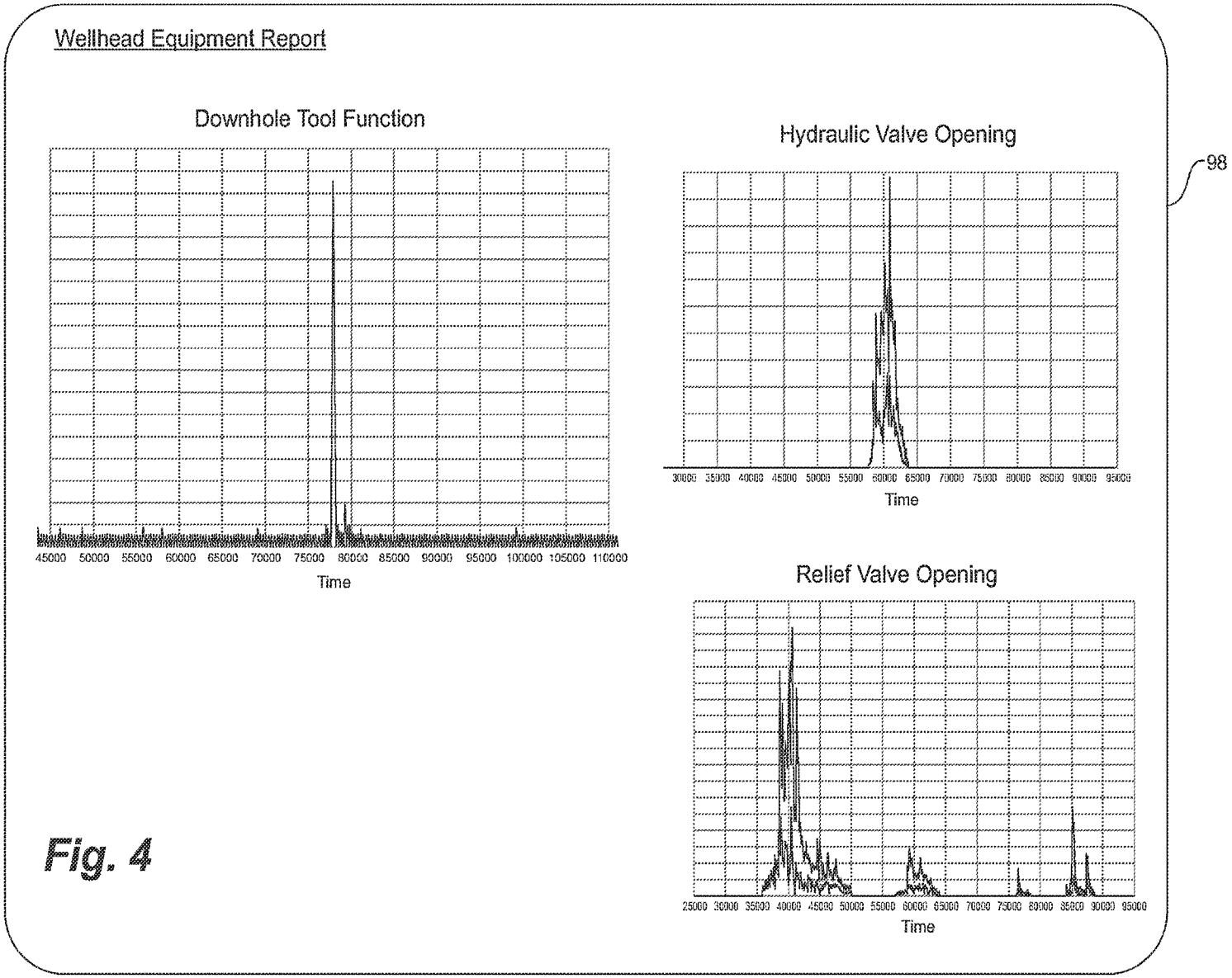
FIG. 4 shows an example wellhead equipment report generated on a user display device of an embodiment of a system of the present invention, in accordance with an embodiment of a method of the present invention.

The user device (50) may then use the transmitted sensor data (whether transmitted in real time, or retrieved from the sensor data log) to generate a wellhead equipment report (step 96). The wellhead equipment report may comprise the transmitted sensor data, as well as graphical representations thereof. As an example, FIG. 4 shows a wellhead equipment report that shows the sensor data (vertical axis) over time (horizontal axis) related to the opening of one of the valve assemblies (2, 4, 6), a relief valve, and the operation of a downhole tool.

In some embodiments, the data reported can be received and used to make decisions in real time to maintain or adjust operations as the job is happening. Further, the reports can be used at the end of the job so the user can use the information as a reference and possibly compare one well or job to another.

In some embodiments, the system can reference and compare known data signatures with what is currently being sensed. In such a case the system can then report to the user/operator what activity the system is sensing without the user/operator needing to know what a specific signature is. For example, the system can report that there is a 95% chance that X activity happened downhole. In other words, the system can interpret the sensed data to provide a recommended conclusion.

In some embodiments, the system can monitor the natural or baseline vibration frequency of elements in the system to be monitored, both at surface as well as downhole, in order to predict conditions of the elements or events, such as failures, when or before they happen. In addition, the system can include or add a different profile for similar elements, changing the natural frequency of each element and therefore telling a user which element is having a potential issue. In some embodiments, multiple sensors can be used in the system in order to better target where a failure may be occurring, including elements having the same or different natural frequencies. In one, non-limiting example, a new valve can have a natural frequency of X and a valve washing out would have a frequency of Y. When a frequency value of Y is detected, or observed, the conclusion can be made that the valve is near its life end and a decision can be made to replace it before it washes out and causes an incident. As such, the system can have a predictive failure analysis.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

The embodiments of the invention in which an exclusive property or privilege is claimed are defined as follows:

1. A method for monitoring an internal operational state of a wellhead equipment and downhole activity using a sensor device, the method comprising the steps of:

(a) in response to a vibration of the wellhead equipment caused by a change in the internal operational state of the wellhead equipment or a downhole event, generating a first electronic sensor signal with a first vibration sensor of the sensor device and a second electronic sensor signal with a second vibration sensor of the sensor device, wherein the sensor device is positioned on the wellhead equipment with the second vibration sensor positioned uphole relative to the first vibration sensor;

(b) generating sensor data based on the first and second generated electronic sensor signals, comprising performing noise cancellation based on relative positioning of the first and second vibration sensors; and (c) transmitting an electronic data signal for the generated sensor data via a communications network to a user device.

2. The method of claim 1 wherein the step of transmitting the electronic data signal is performed in real time with respect to the step of generating the sensor data.

3. The method of claim 1 wherein:

(a) the sensor device further comprises a sensor memory;

(b) the method further comprises storing the generated sensor data in the sensor memory; and (c) the electronic data signal is generated based on the sensor data stored in the sensor memory.

4. The method of claim 1, wherein:

(a) the method further comprises receiving a query from the user device via the communications network; and (b) the step of transmitting the electronic data signal is responsive to receiving the query.

5. The method of claim 1 further comprising generating a report on a user output device of the user device, the report comprising an audible or a visible representation of the transmitted sensor data.

6. The method of claim 1 further comprising using the generated sensor data to make real-time decisions to maintain or adjust operations as a job is happening.

7. The method of claim 1 further comprising using the generated sensor data to determine a proper isolation of well bore zones.

8. The method of claim 7 further comprising pumping fracturing fluid into the well bore.

9. The method of claim 1 further comprising using the generated sensor data at the end of a job as a reference to compare to another job.

10. The method of claim 1 wherein the downhole event comprises an event selected from the group consisting of fractures due to fracking, burst discs rupturing, packers setting, casing breaching, seismic activity due to fracking, and a combination thereof.

11. The method of claim 1, further comprising predicting a physical condition of one or more equipment elements of the wellhead equipment or downhole equipment using the generated sensor data and a natural frequency of the one or more equipment elements.

12. The method claim 11, wherein the predicting comprises a predictive failure analysis.

13. The method of claim 1, wherein the performing noise cancellation comprises performing cross-cancellation using the first generated electronic sensor signal or the second generated electronic sensor signal.

14. A sensor device for monitoring an internal operational state of a wellhead equipment and downhole activity, the sensor device used with a user device in communication with the sensor device via a communications network, the sensor device mounted or mountable on the wellhead equipment, the sensor device comprising:

(a) a first vibration sensor for generating a first electronic sensor signal and a second vibration sensor positionable uphole of the first vibration sensor and for generating a second electronic sensor signal, the first and the second electronic sensor signals generated in response to a vibration of the wellhead equipment;

(b) a sensor communication device for transmitting electronic signals to the user device via the communications network;

(c) a processor operatively connected to the vibration sensor, the sensor communication device, and a sensor memory comprising a non-transitory computer readable medium storing a set of instructions executable by the sensor processor to implement a method comprising the steps of:

(i) generating sensor data based on the first and second electronic sensor signals, comprising performing noise cancellation based on relative positioning of the first and the second vibration sensors; and (ii) transmitting an electronic data signal for the generated sensor data via the communications network to the user device, using the sensor communication device.

15. The sensor device of claim 14 wherein the step of transmitting the electronic data signal is performed in real time with respect to the step of generating the sensor datum.

16. The sensor device of claim 14, wherein:

(a) the method further comprises storing the generated sensor data in the sensor memory; and (b) the electronic data signal is generated based on the sensor data stored in the sensor memory.

17. The sensor device of claim 14 wherein:

(a) the method further comprises receiving, at the sensor device, a query from the user device via the communications network; and (b) the step of transmitting the electronic data signal is responsive to receiving the query.

18. The sensor device of claim 14, wherein the method further comprises predicting a physical condition of one or more equipment elements of the wellhead equipment or downhole equipment using the generated sensor data and a natural frequency of the one or more elements.

19. The sensor device of claim 18, wherein the predicting comprises a predictive failure analysis.

20. The sensor device of claim 14, wherein the performing noise cancellation comprises performing cross-cancellation using the first generated electronic sensor signal or the second generated electronic sensor signal.

* * * * *